US012171268B2

(12) United States Patent
Xu et al.

(10) Patent No.: US 12,171,268 B2
(45) Date of Patent: Dec. 24, 2024

(54) ELECTRONIC VAPORIZATION DEVICE BODY AND ELECTRONIC VAPORIZATION DEVICE

(71) Applicant: SHENZHEN RELX TECHNOLOGY CO., LTD., Shenzhen (CN)

(72) Inventors: Shengyang Xu, Shenzhen (CN); Ruofeng Li, Shenzhen (CN)

(73) Assignee: SHENZHEN RELX TECHNOLOGY CO., LTD., ShenZhen (CN)

( * ) Notice: Subject to any disclaimer, the term of this patent is extended or adjusted under 35 U.S.C. 154(b) by 394 days.

(21) Appl. No.: 17/634,880

(22) PCT Filed: May 31, 2021

(86) PCT No.: PCT/CN2021/097154
§ 371 (c)(1),
(2) Date: Feb. 11, 2022

(87) PCT Pub. No.: WO2022/116498
PCT Pub. Date: Jun. 9, 2022

(65) Prior Publication Data

US 2022/0354178 A1 Nov. 10, 2022

(30) Foreign Application Priority Data

Dec. 3, 2020 (CN) ..... 202022898787.1

(51) Int. Cl.
*A24F 40/48* (2020.01)
*A24F 40/10* (2020.01)

(52) U.S. Cl.
CPC ..... *A24F 40/48* (2020.01); *A24F 40/10* (2020.01)

(58) Field of Classification Search
CPC ..... A24F 40/42; A24F 40/40; A24F 40/48; A24F 40/10; A24F 40/485
See application file for complete search history.

(56) References Cited

U.S. PATENT DOCUMENTS

2020/0085110 A1 3/2020 Force

FOREIGN PATENT DOCUMENTS

CN 208048026 U 11/2018
CN 208523787 U * 2/2019
(Continued)

OTHER PUBLICATIONS

PCT International Search Report mailed Aug. 26, 2021 in counterpart PCT application PCT/CN2021/097154, 5 pages in Chinese.

*Primary Examiner* — Jean F Duverne
(74) *Attorney, Agent, or Firm* — ScienBiziP, P.C.

(57) ABSTRACT

An electronic vaporization device body is provided. The electronic vaporization device body includes a housing. The housing includes an accommodation region for accommodating a vaporizable material storage device. A bottom surface of the accommodation region includes a hollow ventilation structure, a liquid blocking member, and a supporting portion. A region surrounded by the hollow ventilation structure forms a first gas channel. The liquid blocking member has a cover, and the cover is located in the accommodation region and covers the first gas channel. The supporting portion is disposed between the hollow ventilation structure and the cover to support the cover on the hollow ventilation structure, and the supporting portion is provided with a second gas channel in communication with the first gas channel and the accommodation region.

14 Claims, 9 Drawing Sheets

(56) References Cited

FOREIGN PATENT DOCUMENTS

| | | | | | |
|---|---|---|---|---|---|
| CN | 105559151 | B | * | 5/2019 | ..... A24F 40/05 |
| CN | 208909136 | U | | 5/2019 | |
| CN | 210203317 | U | | 3/2020 | |
| CN | 210407103 | U | | 4/2020 | |
| CN | 211091883 | U | | 7/2020 | |
| CN | 211211432 | U | | 8/2020 | |
| CN | 211407659 | U | | 9/2020 | |
| WO | WO-2019144308 | A1 | * | 8/2019 | ..... A24F 40/40 |

* cited by examiner

ELECTRONIC VAPORIZATION DEVICE BODY AND ELECTRONIC VAPORIZATION DEVICE

CROSS-REFERENCE TO RELATED APPLICATION

This application is a national stage application filed under 35 U.S.C § 371 of International Application No. PCT/CN2021/097154 filed May 31, 2021, which claims priority to China Patent Application 202022898787.1 filed Dec. 3, 2020. The entire disclosures of the above applications are incorporated herein by reference in their entireties.

TECHNICAL FIELD

This application relates to an electronic device, and specifically, to an electronic vaporization device body and an electronic vaporization device.

BACKGROUND

In recent years, major manufacturers begin to produce a variety of electronic vaporization device products, including e-liquid electronic vaporization device products that heat and atomize volatile solutions and generate aerosols for users to inhale. The electronic vaporization devices generally use sensors to sense an inhalation action of a user. The e-liquid stored in the e-liquid electronic vaporization device products or condensates produced after the aerosol is cooled may leak to the sensors during use, affecting the operation of the sensors.

SUMMARY

This application provides an electronic vaporization device body and an electronic vaporization device, to prevent condensates from entering an electronic vaporization device body by using a method different from the prior art, and provide users with a different experience.

The present utility model provides an electronic vaporization device body. The electronic vaporization device body includes a housing. The housing includes an accommodation region for accommodating a vaporizable material storage device. A bottom surface of the accommodation region includes a hollow ventilation structure, a liquid blocking member, and a supporting portion. A region surrounded by the hollow ventilation structure forms a first gas channel. The liquid blocking member has a cover, and the cover is located in the accommodation region and covers the first gas channel. The supporting portion is disposed between the hollow ventilation structure and the cover to support the cover on the hollow ventilation structure, and the supporting portion is provided with a second gas channel in communication with the first gas channel and the accommodation region.

In an implementation, the supporting portion and the cover are integrally formed.

In an implementation, the supporting portion is formed at a top end of the hollow ventilation structure.

In an implementation, the supporting portion includes at least two protruding pieces arranged symmetrically.

In an implementation, the at least two protruding pieces have a height ranging from 0.2 mm to 0.5 mm.

In an implementation, the height of the at least two protruding pieces is 0.3 mm.

In an implementation, the liquid blocking member further includes an extension portion, and the extension portion extends in a direction towards the first gas channel and is disposed coaxially with the first gas channel.

In an implementation, there is a gap between an outer peripheral wall of the extension portion and an inner wall of the first gas channel, and the gap is in communication with the first gas channel and the second gas channel.

In an implementation, a ventilation structure is disposed in the extension portion, and two ends of the ventilation structure are respectively in communication with the first gas channel and the second gas channel.

In an implementation, the ventilation structure includes a third gas channel and a fourth gas channel. The third gas channel extends in an axial direction, and one end of the third gas channel is in communication with the first gas channel. The fourth gas channel extends in a radial direction, and the fourth gas channel is in communication with the other end of the third gas channel and the second gas channel.

The present utility model provides an electronic vaporization device. The electronic vaporization device includes a vaporizable material storage device for storing a vaporizable material, and the foregoing electronic vaporization device body.

BRIEF DESCRIPTION OF THE DRAWINGS

The accompanying drawings are provided for further understanding of this application and constitute a part of the specification, and explain this application together with the following specific implementations, but do not constitute a limitation to this application. In the accompanying drawings.

DETAILED DESCRIPTION

Figure 1:
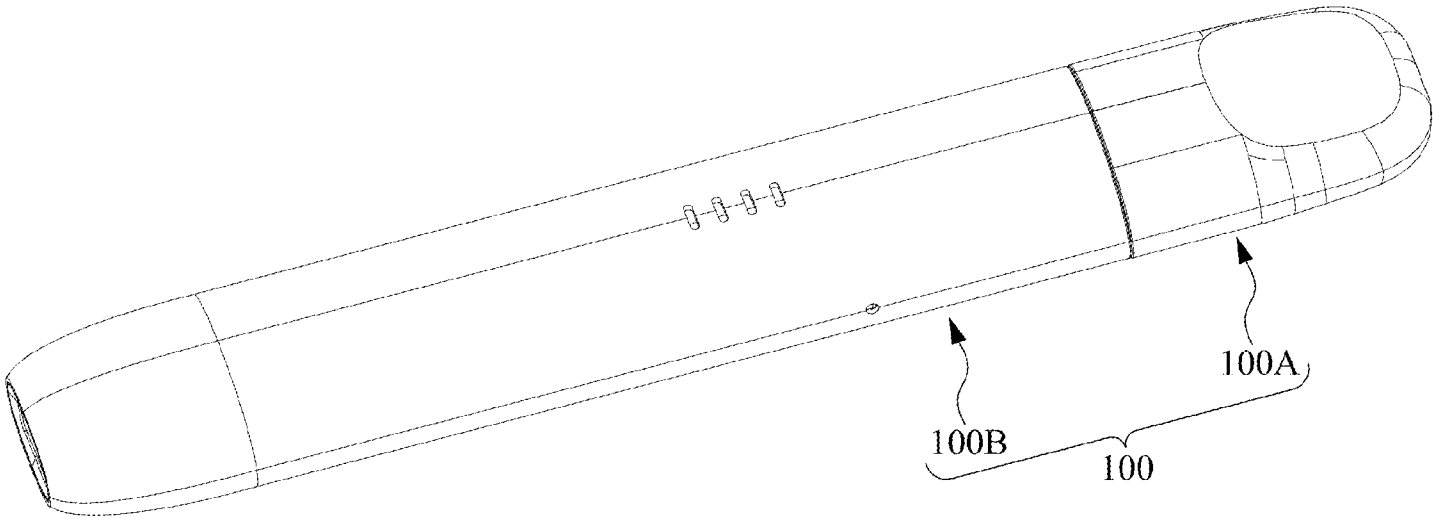
FIG. 1 is a schematic front-view diagram of an electronic vaporization device according to some embodiments of this application.

The following disclosure provides many different embodiments or examples for implementing different features of the provided subject matters. The following describes particular examples of members and deployments. Certainly, these are merely examples and are not intended to be limitative. In this application, in the following descriptions, reference formed by the first feature above or on the second feature may include an embodiment formed by direct contact between the first feature and the second feature, and may further include an embodiment in which an additional feature may be formed between the first feature and the second feature to enable the first feature and the second feature to be not in direct contact. In addition, in this application, reference numerals and/or letters may be repeated in examples. This repetition is for the purpose of simplification and clarity, and does not indicate a relationship between the described various embodiments and/or configurations.

The embodiments of this application are described in detail below. However, it should be understood that, this application provides many applicable concepts that can be implemented in various particular cases. The described particular embodiments are only illustrative and do not limit the scope of this application.

FIG. 1 is a schematic front view diagram of an electronic vaporization device 100 according to some embodiments of this application.

The electronic vaporization device 100 may include a vaporizable material storage device 100A and an electronic vaporization device body 100B (briefly referred to as the body 100B below). In some embodiments, the vaporizable material storage device 100A and the body 100B may be designed as a unity. In some embodiments, the vaporizable material storage device 100A and the body 100B may be designed as two separate members. In some embodiments, the vaporizable material storage device 100A may be designed to be detachably combined with the body 100B. In some embodiments, when the vaporizable material storage device 100A is combined with the body 100B, the vaporizable material storage device 100A is partly accommodated in the body 100B. In some embodiments, the vaporizable material storage device 100A may be referred to as a cartridge or an e-liquid storage assembly. In some embodiments, the body 100B may be referred to as a main body.

The body 100B may provide electric power to the vaporizable material storage device 100A. The electric power provided by the body 100B to the vaporizable material storage device 100A may heat a vaporizable material stored in the vaporizable material storage device 100A. The vaporizable material may be a liquid. The vaporizable material may be a solution. The vaporizable material may alternatively be referred to as e-liquid. The e-liquid is edible.

Figure 2:
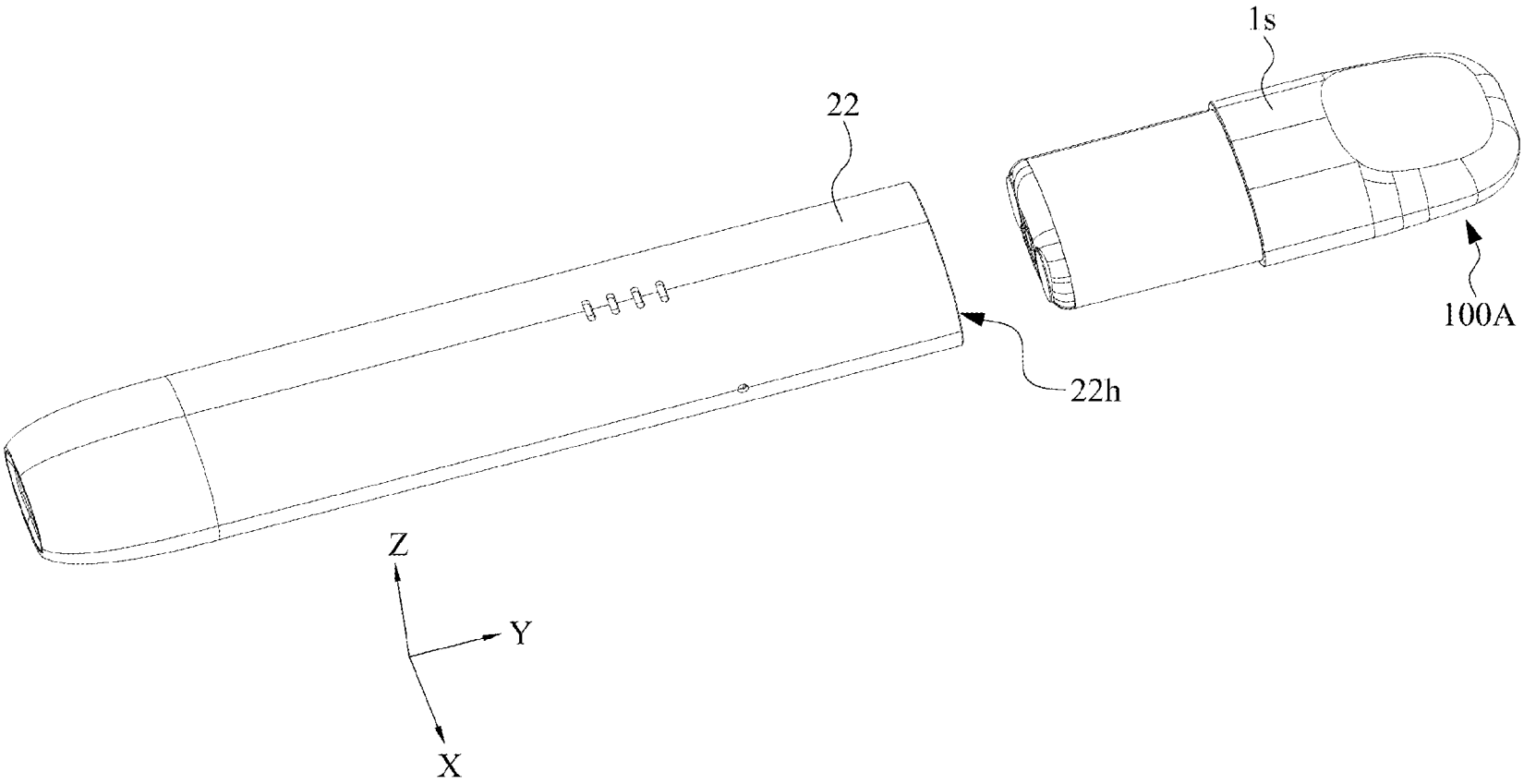
FIG. 2 is an exemplary schematic combination diagram of an electronic vaporization device according to some embodiments of this application.

FIG. 2 is an exemplary schematic combination diagram of an electronic vaporization device 100 according to some embodiments of this application.

The body 100B has a body housing 22. The body housing 22 has an opening 22*h*. The opening 22*h* may accommodate a part of the vaporizable material storage device 100A. In some embodiments, the vaporizable material storage device 100A may not have directivity. In some embodiments, the vaporizable material storage device 100A may be detachably combined with the body 100B in two manners: a surface 1*s* faces a Z-axis direction or the surface 1*s* flips towards the −Z-axis direction.

Figure 3:
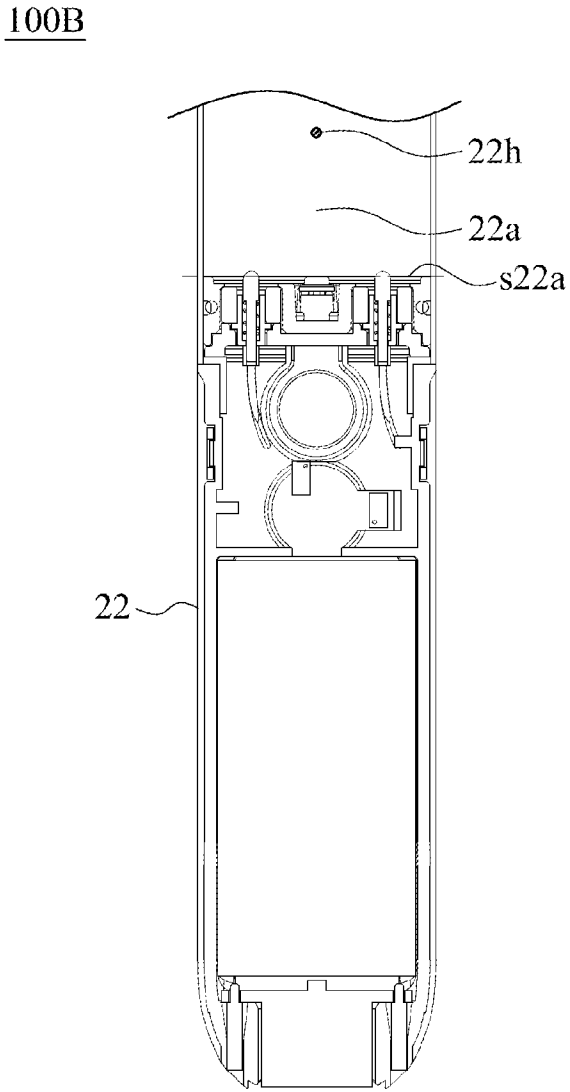
FIG. 3 is a schematic cross-sectional view of an electronic vaporization device body according to some embodiments of this application.
Figure 4A:
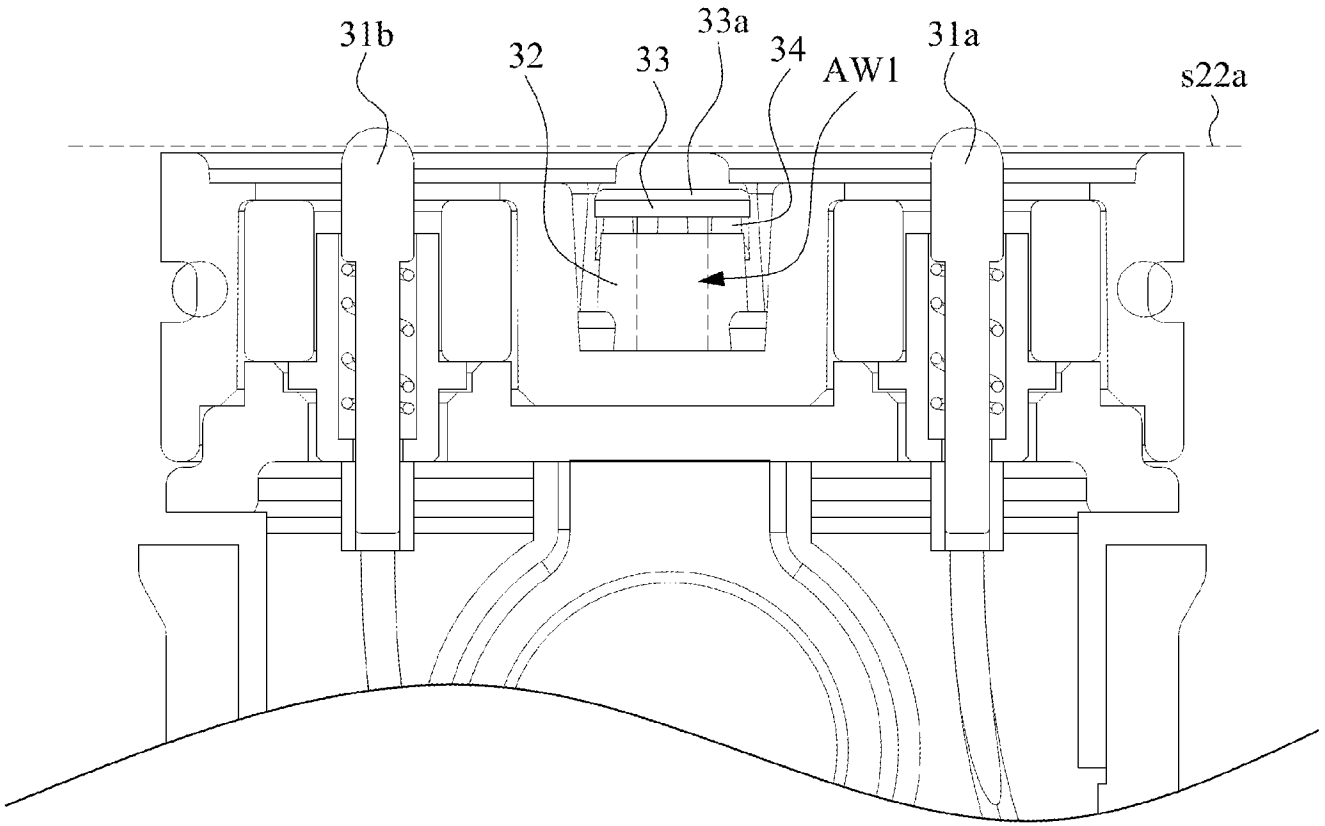
FIG. 4A to FIG. 4C are respectively a cross-sectional enlarged view, a top enlarged view, and a stereoscopic enlarged view of an electronic vaporization device body according to some embodiments of this application.
Figure 4B:
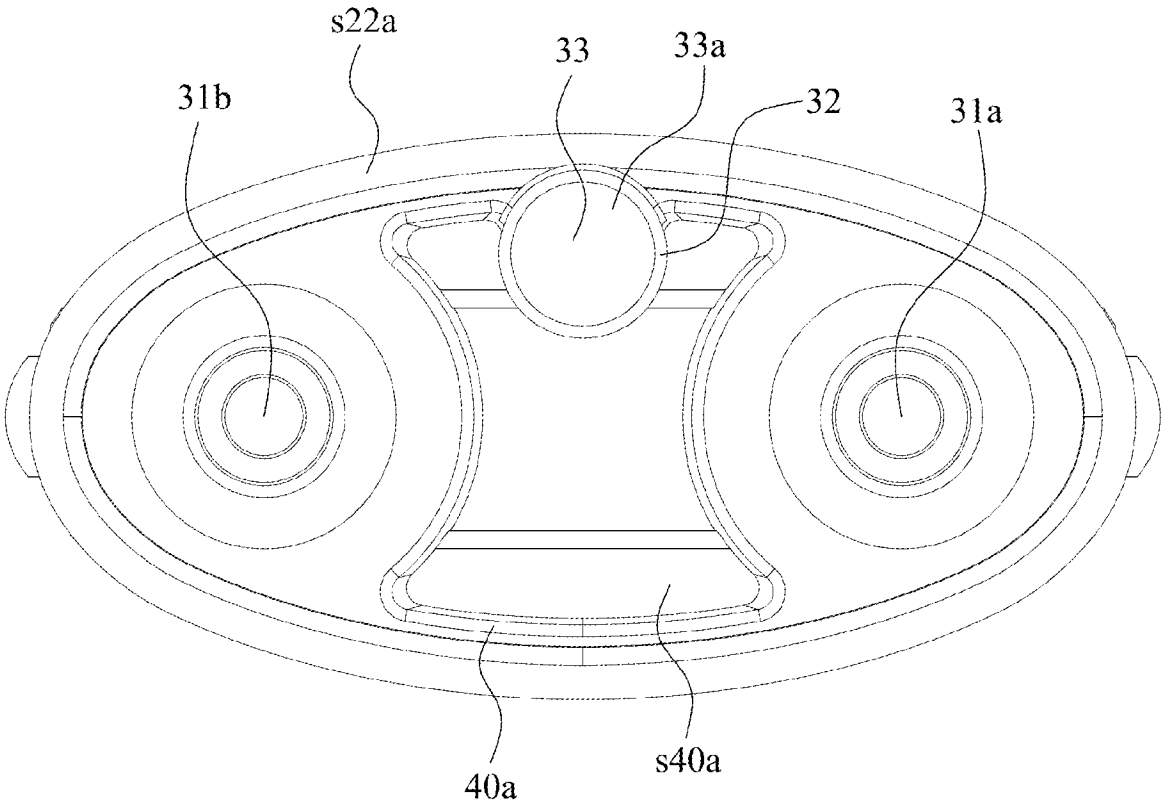
Figure 4C:
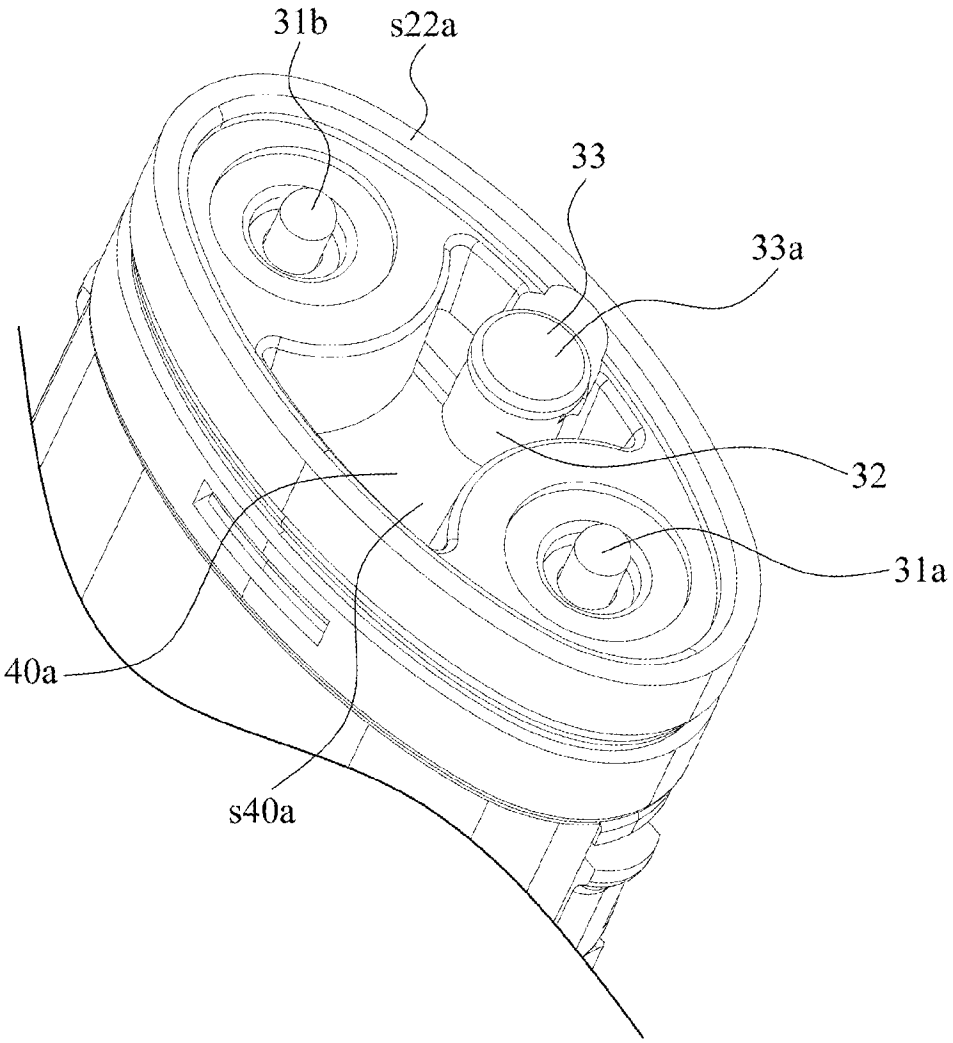

FIG. 3 is a schematic front cross-sectional view of the body 100B according to some embodiments of this application. In some embodiments, the body 100B includes an accommodation region 22*a*. When the vaporizable material storage device 100A is combined with the body 100B, the accommodation region 22*a* is used to accommodate the vaporizable material storage device 100A. FIG. 4A to FIG. 4C are respectively a cross-sectional enlarged view, a top view, and a stereoscopic view of the body 100B according to some embodiments of this application.

In some embodiments, a bottom surface s22*a* of the accommodation region 22*a* includes electrical connection terminals 31*a* and 31*b*, a hollow ventilation structure 32, a liquid blocking member 33, and a supporting portion 34. The body 100B transmits the electric power to the vaporizable material storage device 100A by using the electrical connection terminals 31*a* and 31*b* to vaporize the vaporizable material for the user to inhale. In some embodiments, the electrical connection terminals 31*a* and 31*b* are respectively disposed on two sides of a groove 40*a*. The groove 40*a* may be used as a liquid storage groove for accommodating the condensate. In some embodiments, the hollow ventilation structure 32 is disposed in the groove 40*a*. In some embodiments, a region surrounded by the hollow ventilation structure 32 forms a first gas channel AW1. In some embodiments, a top opening of the hollow ventilation structure 32 is higher than a bottom surfaces 40*a* of the groove 40*a*, to prevent the condensate in the groove 40*a* from entering the first gas channel AW1.

In some embodiments, the liquid blocking member 33 at least includes a cover 33*a*. The cover 33*a* is located in the accommodation region 22*a* and covers the first gas channel AW1. In some embodiments, the supporting portion 34 is disposed between the hollow ventilation structure 32 and the cover 33*a*. The supporting portion 34 is configured to support the cover 33*a* on the hollow ventilation structure 32.

Figure 5:
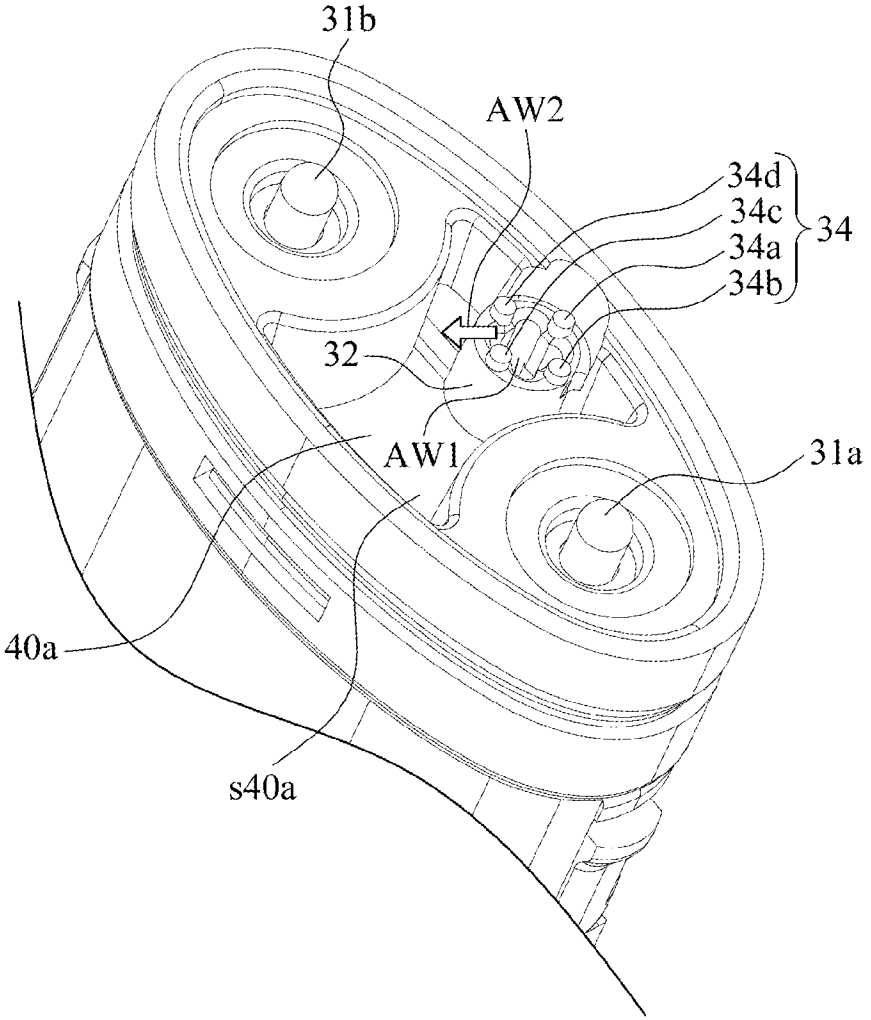
FIG. 5 is a schematic diagram of a supporting portion according to some embodiments of this application.

FIG. 5 is a schematic diagram of the supporting portion 34 according to some embodiments of this application. In some embodiments, the supporting portion 34 includes protruding pieces 34*a*, 34*b*, 34*c*, and 34*d*. In some embodiments, the supporting portion 34 is provided with a second gas channel AW2 in communication with the first gas channel AW1 and the accommodation region 22*a*. In some embodiments, the second gas channel AW2 is disposed between two adjacent protruding pieces. In some embodiments, the protruding pieces 34*a* to 34*d* are arranged symmetrically. In another embodiment, the protruding pieces 34*a* to 34*d* may not be arranged symmetrically. It should be noted that although the supporting portion 34 in the embodiment of FIG. 5 includes the protruding pieces 34*a* to 34*d*, in another embodiment, the supporting portion 34 may include one, two, three, or more than four protruding pieces. In addition, when the supporting portion 34 includes two, three, or more than four protruding pieces, the protruding pieces may be arranged symmetrically or asymmetrically. A person skilled in the art should understand that, provided that the supporting portion 34 can support the cover 33*a* on the hollow ventilation structure 32 and is provided with the second gas channel AW2 in communication with the first gas channel AW1 and the accommodation region 22*a*, the detailed structure shall fall within the scope of this application.

In some embodiments, the supporting portion 34 may be designed to extend downward from the cover 33*a* and be integrally formed with the cover 33*a*. In some embodiments, the supporting portion 34 may be formed at a top end of the hollow ventilation structure 32. An implementation of the supporting portion 34 is not limited in this application. In some embodiments, the protruding pieces 34*a* to 34*d* have a height ranging from 0.2 mm to 0.5 mm. In some embodiments, the height of the protruding pieces 34*a* to 34*d* is 0.3 mm.

In this application, the cover 33*a* of the liquid blocking member 33 covers the first gas channel AW1, so that even if the condensate is formed on the bottom surfaces 22*a* of the accommodation region 22*a*, the liquid blocking member 33 can still effectively prevent the condensate from entering the first gas channel AW1 and further entering the body 100B to destroy internal electronic hardware and cause the body 100B to fail. In addition, in this application, the cover 33*a* is supported on the hollow ventilation structure 32 by using the supporting portion 34, and the second gas channel AW2 is disposed in the supporting portion 34, thereby maintaining the communication between the first gas channel AW1 and the accommodation region 22*a*. With such settings, when the vaporizable material storage device 100A is combined with the body 100B, air flow may still leave the body 100B from the first gas channel AW1 and the second gas channel AW2 and enter the vaporizable material storage device 100A. The body 100B may sense the air flow leaving the body 100B from the gas channel AW1 and the second gas channel AW2, and then determine an inhalation action of the user.

In some embodiments, the liquid blocking member 33, the supporting portion 34, and the hollow ventilation structure 32 may be integrally formed. In another embodiment, the liquid blocking member 33 may detachably cover the first gas channel AW1. In a case that the liquid blocking member 33 detachably covers the first gas channel AW1, in order to prevent the liquid blocking member 33 from easily sliding off the supporting portion 34 when the user uses the electronic vaporization device 100, the liquid blocking member 33 may be alternatively implemented in another manner.

Figure 6A:
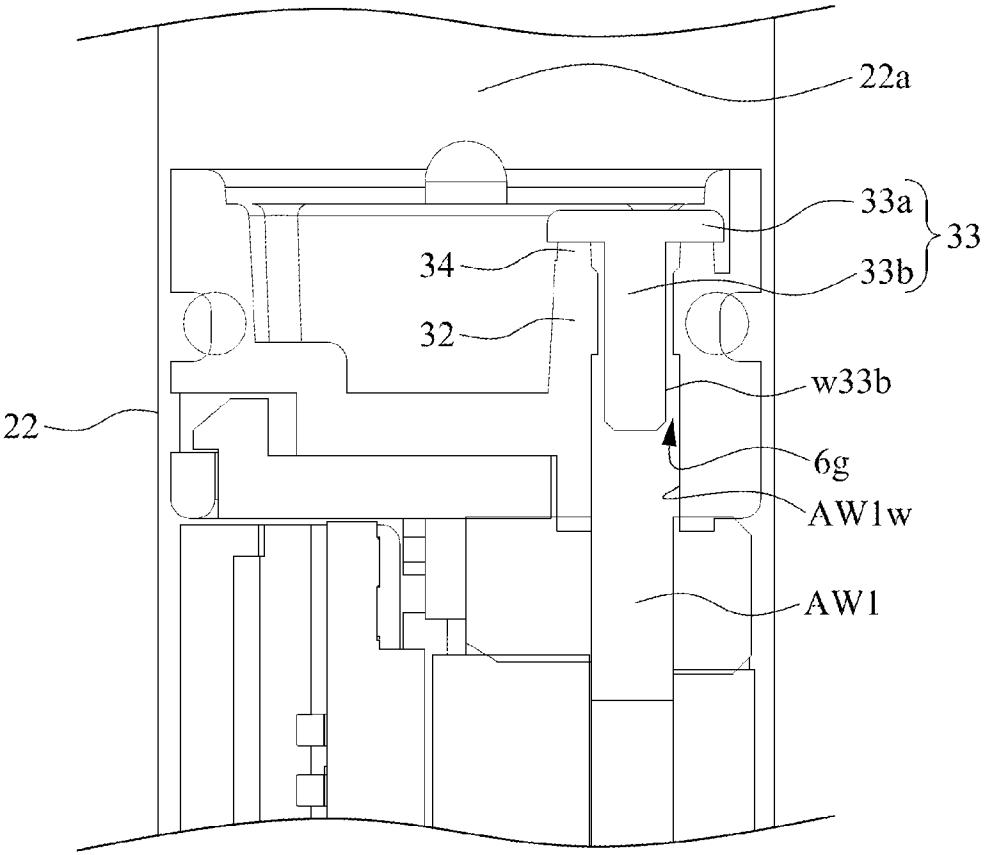
FIG. 6A is a cross-sectional side view of a liquid blocking member according to an embodiment of this application.

FIG. 6A is a cross-sectional side view of a liquid blocking member 33 according to an embodiment of this application. In some embodiments, in addition to the cover 33*a*, the liquid blocking member 33 further includes an extension portion 33*b*. In some embodiments, the extension portion 33*b* extends in the direction towards the first gas channel AW1 and is disposed coaxially with the first gas channel AW1. When the user uses the electronic vaporization device 100, the extension portion 33*b* extending downward into the first gas channel AW1 can effectively prevent the liquid blocking member 33 from sliding off the supporting portion 34.

However, a person skilled in the art should understand that the extension portion 33*b* does not need to extend into the first gas channel AW1 to prevent the liquid blocking member 33 from sliding off the supporting portion 34. For example, if the supporting portion 34 includes the protruding pieces 34*a* to 34*d*, provided that the diameter or width of the extension portion 33*b* is greater than a distance between two opposed protruding pieces, even if a downward extending length of the extension portion 33*b* is not long enough to reach into the first gas channel AW1, the liquid blocking member 33 can still be prevented from sliding off the supporting portion 34.

In some embodiments, there is a gap 6*g* between an outer peripheral wall w33*b* of the extension portion 33*b* and an inner wall AW1*w* of the first gas channel AW1. The gap 6*g* is in communication with the first gas channel AW1 and the second gas channel AW2. With such settings, when the vaporizable material storage device 100A is combined with the body 100B, the air flow may leave the body 100B from the first gas channel AW1, the gap 6*g*, and the second gas channel AW2, and enter the vaporizable material storage device 100A.

In some embodiments, the extension portion 33*b* and the first gas channel AW1 may be designed to have the same shape, and the width of the extension portion 33*b* is designed to be smaller than the width of the first gas channel AW1, to form the gap 6*g* between the outer peripheral wall w33*b* of the extension portion 33*b* and the inner wall AW1*w* of the first gas channel AW1. In some embodiments, the extension portion 33*b* and the first gas channel AW1 may be designed to have different shapes. In this way, when the extension portion 33*b* extends into the first gas channel AW1, the gap 6*g* may be formed between the outer peripheral wall w33*b* of the extension portion 33*b* with a different shape and the inner wall AW1*w* of the first gas channel AW1.

However, this application is not limited to maintaining the communication between the first gas channel AW1 and the second gas channel AW2 by forming the gap 6*g* between the outer peripheral wall w33*b* of the extension portion 33*b* and the inner wall AW1*w* of the first gas channel AW1.

Figure 6B:
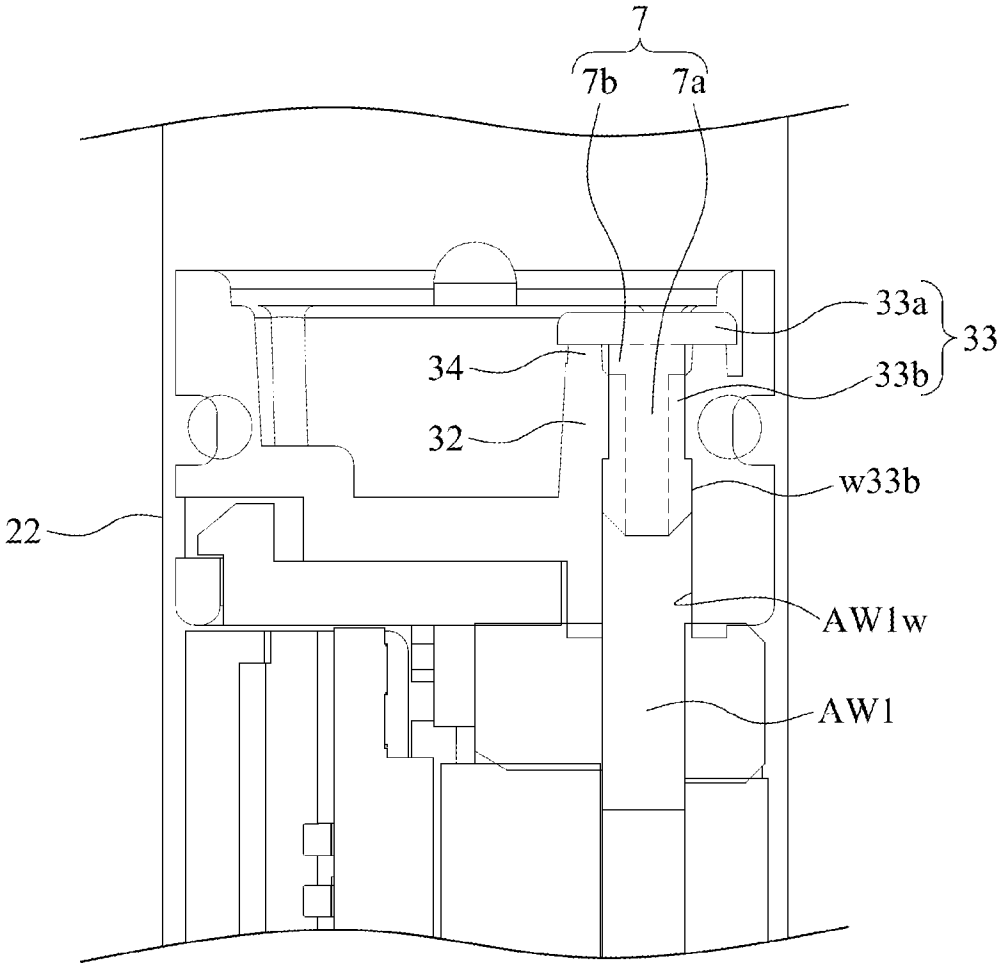
FIG. 6B is a cross-sectional side view of a liquid blocking member according to another embodiment of this application.

FIG. 6B is a cross-sectional side view of a liquid blocking member 33 according to another embodiment of this application. FIG. 6B is substantially the same as FIG. 6A, except that the extension portion 33*b* extending downward into the first gas channel AW1 is tightly fitted with the first gas channel AW1. In other words, there is no gap between the outer peripheral wall w33*b* of the extension portion 33*b* and the inner wall AW1*w* of the first gas channel AW1.

In some embodiments, a ventilation structure 7 is provided in the extension portion 33*b*. Two ends of the ventilation structure 7 are respectively in communication with the first gas channel AW1 and the second gas channel AW2. In some embodiments, the ventilation structure 7 includes a third gas channel 7*a* and a fourth gas channel 7*b*. In some embodiments, the third gas channel 7*a* extends in an axial direction. One end of the third gas channel 7*a* is in communication with the first gas channel AW1, and the other end is in communication with the fourth gas channel 7*b*. In some embodiments, the fourth gas channel 7*b* extends in a radial direction. The fourth gas channel 7*b* is in communication with the second gas channel AW2.

With such settings, when the vaporizable material storage device 100A is combined with the body 100B, even if there is no gap between the outer peripheral wall w33*b* of the extension portion 33*b* and the inner wall AW1*w* of the first gas channel AW1, the air flow can still enter the vaporizable material storage device 100A from the first gas channel AW1, the third gas channel 7*a*, the fourth gas channel 7*b*, and the second gas channel AW2. It should be noted that this application does not limit the ventilation structure 7 to include the third gas channel 7*a* and the fourth gas channel 7*b* to maintain the communication between the first gas channel AW1 and the second gas channel AW2. Provided that the two ends of the ventilation structure 7 are respectively in communication with the first gas channel AW1 and the second gas channel AW2, the detailed structure shall fall within the scope of this application.

As used herein, the terms "approximately", "basically", "substantially", and "about" are used to describe and consider small variations. When used in combination with an event or a situation, the terms may refer to an example in which an event or a situation occurs accurately and an example in which the event or situation occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all ranges disclosed herein include endpoints. The term "substantially coplanar" may refer to two surfaces within a few micrometers (μm) positioned along the same plane, for example, within 10 μm, within 5 μm, within 1 μm, or within 0.5 μm positioned along the same plane. When reference is made to "substantially" the same numerical value or characteristic, the term may refer to a value within ±10%, ±5%, ±1%, or ±0.5% of the average of the values.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. For example, when being used in combination with a value, the term may refer to a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the value (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%), it may be considered that the two values are "substantially" or "approximately" the same. For example, being "basically" parallel may refer to an angular variation range of less than or equal to ±10° with respect to 0°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may refer to an angular variation range of less than or equal to ±10° with respect to 90°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

For example, two surfaces can be deemed to be coplanar or substantially coplanar if a displacement between the two surfaces is no greater than 5 μm, no greater than 2 μm, no greater than 1 μm, or no greater than 0.5 μm. A surface can be deemed to be planar or substantially planar if a displacement between any two points on the surface with respect to a plane is no greater than 5 μm, no greater than 2 μm, no greater than 1 μm, or no greater than 0.5 μm.

As used herein, the terms "conductive", "electrically conductive" and "electrical conductivity" refer to an ability to transport an electric current. Electrically conductive materials typically indicate those materials that exhibit little or no opposition to the flow of an electric current. One measure of electrical conductivity is Siemens per meter (S/m). Typically, an electrically conductive material is a material having a conductivity greater than approximately 104 S/m, such as at least 105 S/m or at least 106 S/m. The electrical conductivity of a material can sometimes vary with temperature. Unless otherwise specified, the electrical conductivity of a material is measured at room temperature.

As used herein, singular terms "a", "an", and "the" may include plural referents unless the context clearly dictates otherwise. In the description of some embodiments, assemblies provided "on" or "above" another assembly may encompass a case in which a previous assembly is directly on a latter assembly (for example, in physical contact with the latter assembly), and a case in which one or more intermediate assemblies are located between the previous assembly and the latter assembly.

As used herein, for ease of description, space-related terms such as "under", "below", "lower portion", "above", "upper portion", "lower portion", "left side", "right side", and the like may be used herein to describe a relationship between one member or feature and another member or feature as shown in the figures. In addition to orientation shown in the figures, space-related terms are intended to encompass different orientations of the device in use or operation. A device may be oriented in other ways (rotated 90 degrees or at other orientations), and the space-related descriptors used herein may also be used for explanation accordingly. It should be understood that when a member is "connected" or "coupled" to another member, the member may be directly connected to or coupled to another member, or an intermediate member may exist.

Several embodiments of this disclosure and features of details are briefly described above. The embodiments described in this disclosure may be easily used as a basis for designing or modifying other processes and structures for realizing the same or similar objectives and/or obtaining the same or similar advantages introduced in the embodiments in the specification. Such equivalent construction does not depart from the spirit and scope of this disclosure, and various variations, replacements, and modifications can be made without departing from the spirit and scope of this disclosure.

What is claimed is:

1. An electronic vaporization device body, comprising a housing, the housing comprising an accommodation region for accommodating a vaporizable material storage device, wherein a bottom surface of the accommodation region comprises:

a hollow ventilation structure, a region surrounded by the hollow ventilation structure forming a first gas channel;

a liquid blocking member, comprising a cover and an extension portion, the cover being located in the accommodation region and covering the first gas channel, and the extension portion extending in a direction towards the first gas channel; and a supporting portion, disposed between the hollow ventilation structure and the cover to support the cover on the hollow ventilation structure, the supporting portion being provided with a second gas channel in communication with the first gas channel and the accommodation region, wherein a ventilation structure is disposed in the extension portion, two ends of the ventilation structure are respectively in communication with the first gas channel and the second gas channel, the ventilation structure comprises a third gas channel extending in an axial direction and a fourth gas extending in a radial direction, one end of the third gas channel is in communication with the first gas channel, and the fourth gas channel is in communication with the other end of the third gas channel and the second gas channel.

2. The electronic vaporization device body of claim 1, wherein the supporting portion and the cover are integrally formed.

3. The electronic vaporization device body of claim 1, wherein the supporting portion is formed at a top end of the hollow ventilation structure.

4. The electronic vaporization device body of claim 1, wherein the supporting portion comprises at least two protruding pieces arranged symmetrically.

5. The electronic vaporization device body of claim 1, wherein the at least two protruding pieces have a height ranging from 0.2 mm to 0.5 mm.

6. The electronic vaporization device body of claim 3, wherein the height of the at least two protruding pieces is 0.3 mm.

7. The electronic vaporization device body of claim 1, wherein there is a gap between an outer peripheral wall of the extension portion and an inner wall of the first gas channel, and the gap is in communication with the first gas channel and the second gas channel.

8. An electronic vaporization device, comprising a vaporizable material storage device for storing a vaporizable material and an electronic vaporization device body comprising a housing, the housing comprising an accommodation region for accommodating the vaporizable material storage device, wherein a bottom surface of the accommodation region comprises:

a hollow ventilation structure, a region surrounded by the hollow ventilation structure forming a first gas channel;

a liquid blocking member, comprising a cover and an extension portion, the cover being located in the accommodation region and covering the first gas channel, and the extension portion extending in a direction towards the first gas channel and being disposed coaxially with the first gas channel and being disposed coaxially with the first gas channel; and a supporting portion, disposed between the hollow ventilation structure and the cover to support the cover on the hollow ventilation structure, the supporting portion being provided with a second gas channel in communication with the first gas channel and the accommodation region, wherein a ventilation structure is disposed in the extension portion, two ends of the ventilation structure are respectively in communication with the first gas channel and the second gas channel, the ventilation structure comprises a third gas channel extending in an axial direction and a fourth gas extending in a radial direction, one end of the third gas channel is in communication with the first gas channel, and the fourth gas channel is in communication with the other end of the third gas channel and the second gas channel.

9. The electronic vaporization device of claim 8, wherein the supporting portion and the cover are integrally formed.

10. The electronic vaporization device of claim 8, wherein the supporting portion is formed at a top end of the hollow ventilation structure.

11. The electronic vaporization device of claim 8, wherein the supporting portion comprises at least two protruding pieces arranged symmetrically.

12. The electronic vaporization device of claim 8, wherein the at least two protruding pieces have a height ranging from 0.2 mm to 0.5 mm.

13. The electronic vaporization device of claim 10, wherein the height of the at least two protruding pieces is 0.3 mm.

14. The electronic vaporization device of claim 8, wherein there is a gap between an outer peripheral wall of the extension portion and an inner wall of the first gas channel, and the gap is in communication with the first gas channel and the second gas channel.

* * * * *